US006341894B1

(12) United States Patent
Quinones

(10) Patent No.: US 6,341,894 B1
(45) Date of Patent: Jan. 29, 2002

(54) ACCESSORY CARRYING CASE

(76) Inventor: Juanita Merced Quinones, 5851 Friedley Ave., Newport Richey, FL (US) 34652

( * ) Notice: Subject to any disclaimer, the term of this patent is extended or adjusted under 35 U.S.C. 154(b) by 0 days.

(21) Appl. No.: 09/718,332

(22) Filed: Nov. 22, 2000

(51) Int. Cl.[7] ..... B65D 33/14

(52) U.S. Cl. ..... 383/22; 383/13; 383/39

(58) Field of Search ..... 383/6, 13, 22, 383/38, 39, 40; 150/101, 102, 134; 190/101

(56) References Cited

U.S. PATENT DOCUMENTS

| | | | | | |
|---|---|---|---|---|---|
| 1,392,716 | A | * | 10/1921 | Spraggins | 383/22 X |
| 1,495,220 | A | * | 5/1924 | Carroll | 383/39 |
| 1,579,023 | A | * | 3/1926 | Myers | 383/39 X |
| 2,441,415 | A | * | 5/1948 | Hoishman | 383/39 |
| 3,139,133 | A | * | 6/1964 | Spector | 383/39 X |
| 3,422,498 | A | * | 1/1969 | Carlson | 150/134 X |
| 3,791,337 | A | * | 2/1974 | Schamblin | 383/22 X |
| 5,533,809 | A | * | 7/1996 | Gorman | 383/22 X |
| 5,730,009 | A | * | 3/1998 | Westfield | 190/101 X |
| 5,779,033 | A | * | 7/1998 | Roegner | 383/39 X |
| 6,155,715 | A | * | 12/2000 | Lake et al. | 190/101 X |

FOREIGN PATENT DOCUMENTS

| | | | | |
|---|---|---|---|---|
| DE | 3150565 A1 | * | 6/1983 | 150/134 |
| FR | 002701640 A1 | * | 8/1994 | 150/102 |

* cited by examiner

*Primary Examiner*—Jes F. Pascua

(57) ABSTRACT

A accessory carrying case for transporting, storing, and presenting accessories for use. The accessory carrying case includes a main member with a first surface and a second surface; a plurality of pockets, each positioned on the second surface of the main member, each one of the plurality of pockets is designed for holding an accessory related to the game of bingo; and a clamp member which is used to selectively couple the main member to a table.

7 Claims, 4 Drawing Sheets

ACCESSORY CARRYING CASE

BACKGROUND OF THE INVENTION

1. Field of the Invention

The present invention relates to carrying cases and more particularly pertains to a new accessory carrying case for transporting, storing, and presenting accessories for use.

2. Description of the Prior Art

The use of carrying cases is known in the prior art. More specifically, carrying cases heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,871,519; U.S. Pat. No. 4,949,843; U.S. Pat. No. Des. 276,954; U.S. Pat. No. 5,190,377; U.S. Pat. No. 5,897,209; and U.S. Pat. No. 2,873,781.

While these devices fulfill their respective, particular objectives and requirements, the aforementioned patents do not disclose a new accessory carrying case. The inventive device includes a main member with a first surface and a second surface; a plurality of pockets, each positioned on the second surface of the main member, each one of the plurality of pockets is designed for holding an accessory related to the game of bingo; and a clamp member which is used to selectively couple the main member to a table.

In these respects, the accessory carrying case according to the present invention substantially departs from the conventional concepts and designs of the prior art, and in so doing provides an apparatus primarily developed for the purpose of transporting, storing, and presenting accessories for use.

SUMMARY OF THE INVENTION

In view of the foregoing disadvantages inherent in the known types of carrying cases now present in the prior art, the present invention provides a new accessory carrying case construction wherein the same can be utilized for transporting, storing, and presenting accessories for use.

The general purpose of the present invention, which will be described subsequently in greater detail, is to provide a new accessory carrying case apparatus and method which has many of the advantages of the carrying cases mentioned heretofore and many novel features that result in a new accessory carrying case which is not anticipated, rendered obvious, suggested, or even implied by any of the prior art carrying cases, either alone or in any combination thereof.

To attain this, the present invention generally comprises a main member with a first surface and a second surface; a plurality of pockets, each positioned on the second surface of the main member, each one of the plurality of pockets is designed for holding an accessory related to the game of bingo; and a clamp member which is used to selectively couple the main member to a table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new accessory carrying case apparatus and method which has many of the advantages of the carrying cases mentioned heretofore and many novel features that result in a new accessory carrying case which is not anticipated, rendered obvious, suggested, or even implied by any of the prior art carrying cases, either alone or in any combination thereof.

It is another object of the present invention to provide a new accessory carrying case which may be easily and efficiently manufactured and marketed.

It is a further object of the present invention to provide a new accessory carrying case which is of a durable and reliable construction.

An even further object of the present invention is to provide a new accessory carrying case which is susceptible of a low cost of manufacture with regard to both materials and labor, and which accordingly is then susceptible of low prices of sale to the consuming public, thereby making such accessory carrying case economically available to the buying public.

Still yet another object of the present invention is to provide a new accessory carrying case which provides in the apparatuses and methods of the prior art some of the advantages thereof, while simultaneously overcoming some of the disadvantages normally associated therewith.

Still another object of the present invention is to provide a new accessory carrying case for transporting, storing, and presenting accessories for use.

Yet another object of the present invention is to provide a new accessory carrying case which includes a main member with a first surface and a second surface; a plurality of pockets, each positioned on the second surface of the main member, each one of the plurality of pockets is designed for holding an accessory related to the game of bingo; and a clamp member which is used to selectively couple the main member to a table.

Still yet another object of the present invention is to provide a new accessory carrying case that is lightweight and foldable for easy storage.

Even still another object of the present invention is to provide a new accessory carrying case that keeps accessories readily available during game play.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
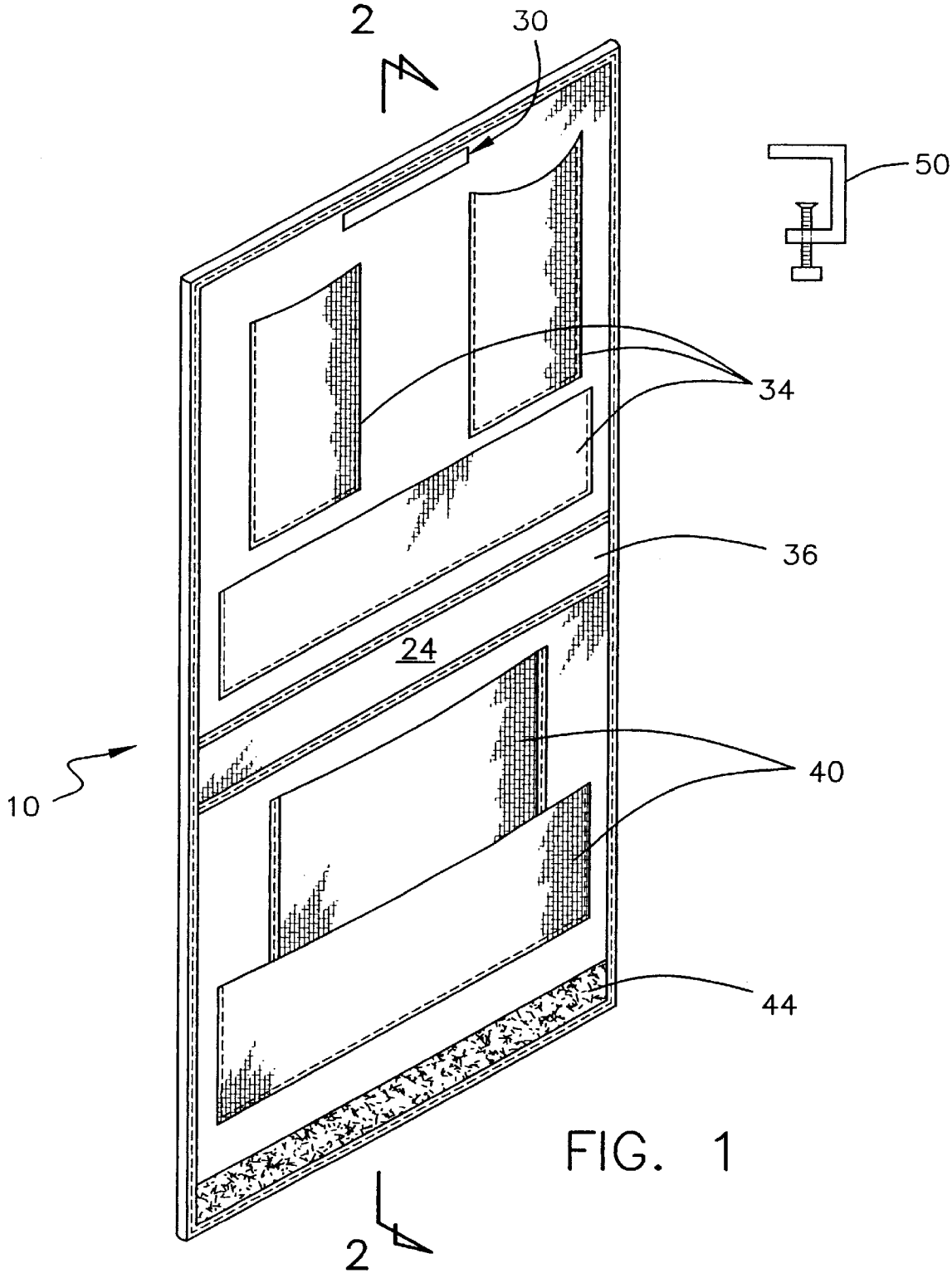
FIG. 1 is a schematic perspective view of a new accessory carrying case according to the present invention.
Figure 2:
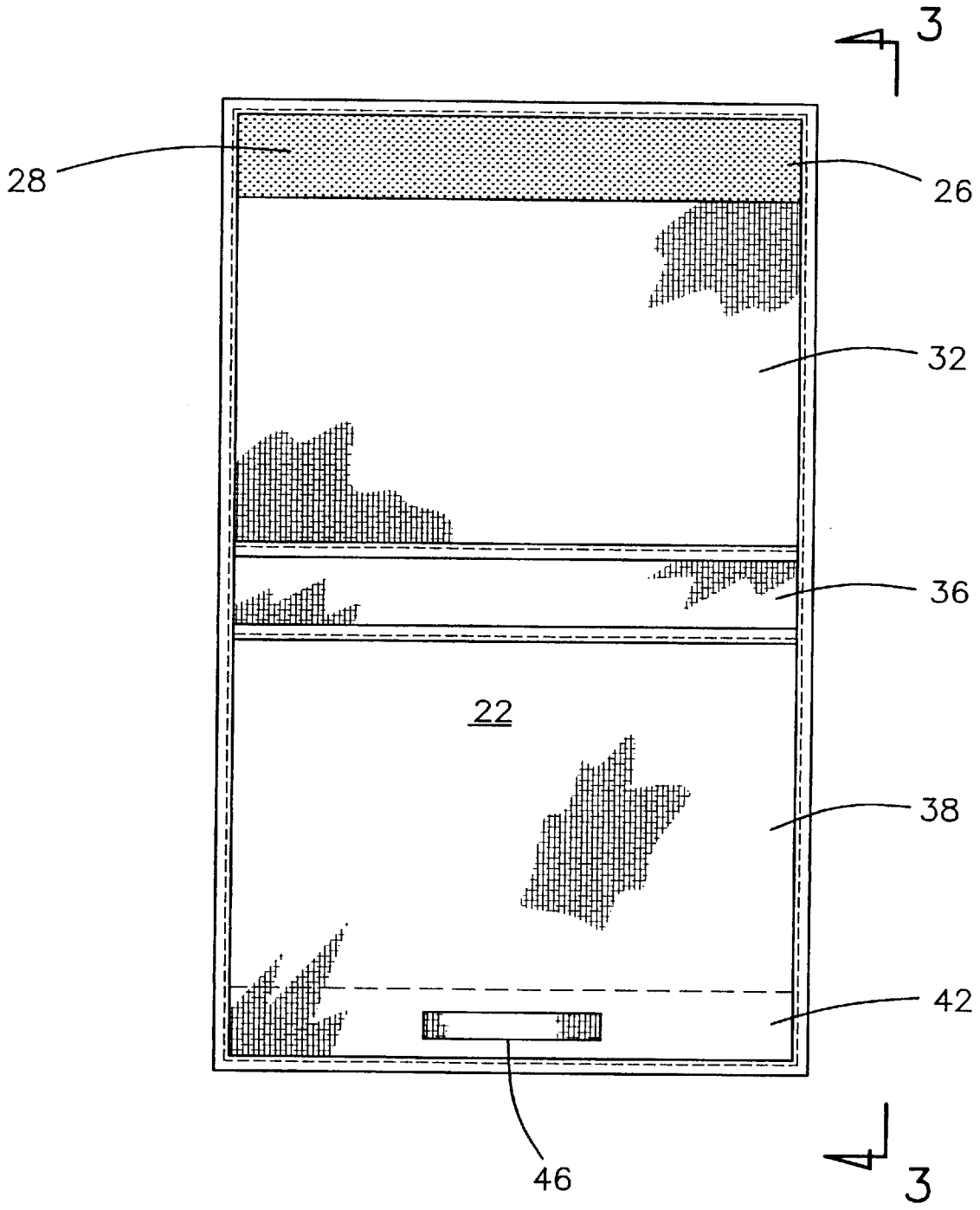
FIG. 2 is a schematic rear view of the present invention.
Figure 3:
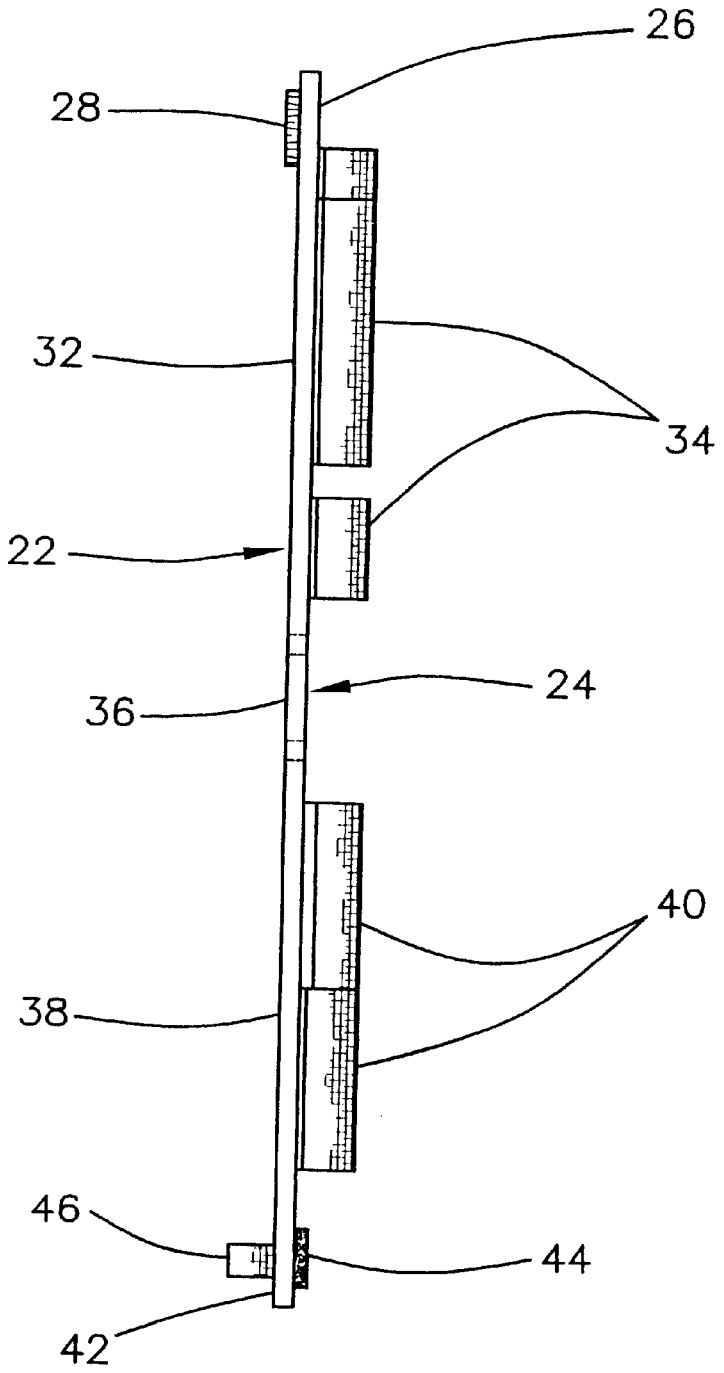
FIG. 3 is a schematic side view of the present invention in an open position.
Figure 4:
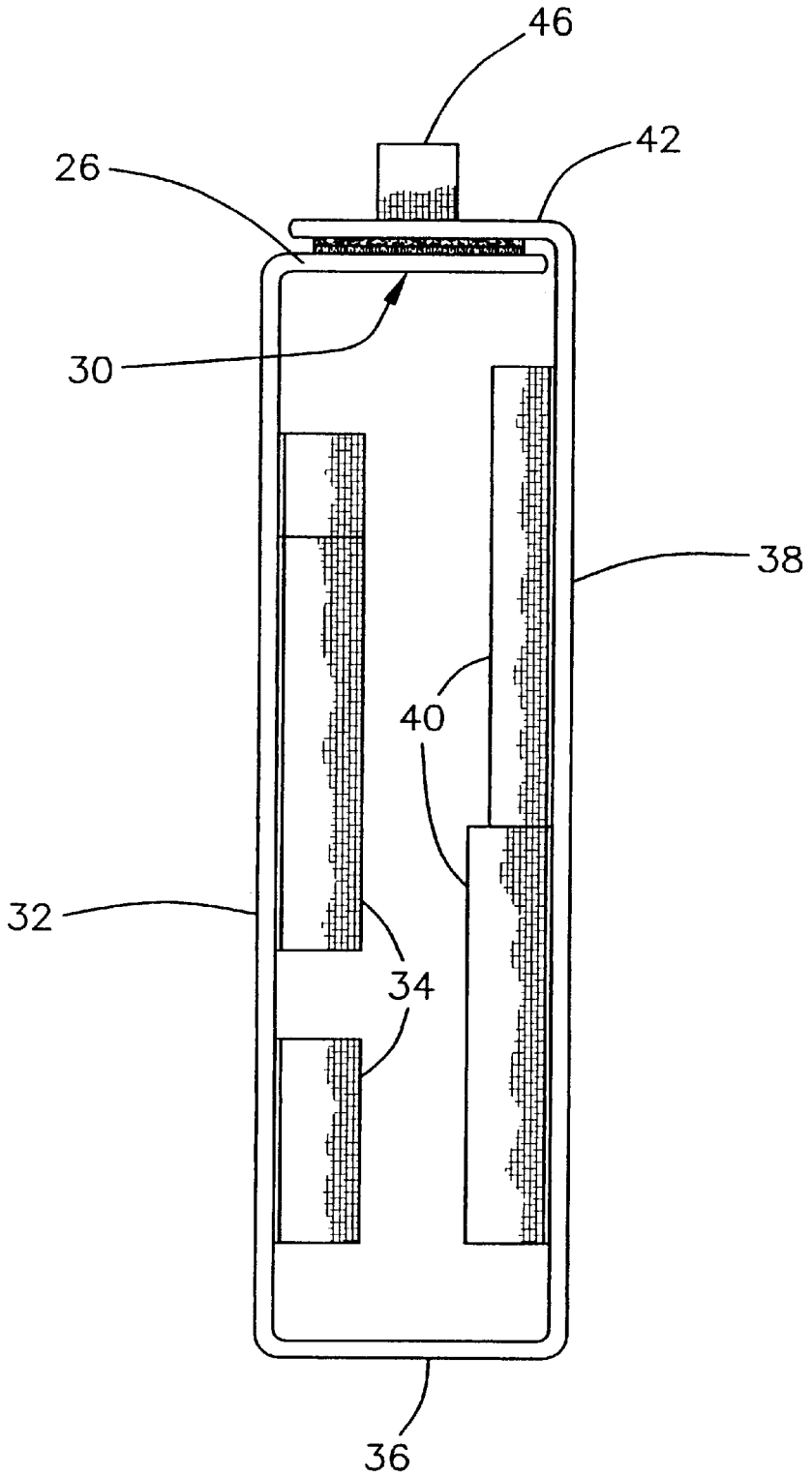
FIG. 4 is a schematic side view of the present invention in a closed position.

With reference now to the drawings, and in particular to FIGS. 1 through 4 thereof, a new accessory carrying case embodying the principles and concepts of the present invention and generally designated by the reference numeral 10 will be described.

As best illustrated in FIGS. 1 through 4, the accessory carrying case 10 generally comprises a main member 20, and a clamp member 50.

The main member 20 includes a first surface 22 and a second surface 24 and is substantially rectangular.

The clamp member 50 is used to selectively couple the main member 20 to a table.

The main member 20 further comprises a first 26, second 32, third 36, fourth 38, and fifth panel member 42. Each of the panel members 26,32,36,38,42 has a first and second surface corresponding to the first 22 and second surfaces 24 of the main member 20. Each of the panel members 26, 32, 36, 38, 42 has a width. The first 26, third 36, and fifth panel members 42 each have a length substantially less than the width. The second 32 and fourth panels 38 each have a length substantially greater than the width.

The first panel member 26 further comprises a first portion of hook and loop fastener 28 and a slit 30. The first portion of hook and loop fastener 28 is positioned on the first panel's 26 first surface. The slit 30 is positioned medially on the first panel 26. The silt 30 is for selectively receiving the clamp member 50. Thus the main member 20 is selectively coupled to a table.

The second panel 32 further comprises a plurality of pockets 34 positioned on the second panel's 32 second surface. Each one of the plurality of pockets 34 is designed for receiving and holding an accessory associated with the game of bingo.

The fourth panel 38 further comprises a second plurality of pockets 40 positioned on the forth panel's 38 second surface. Each one of the second plurality of pockets 40 is designed for receiving an holding an accessory associated with the game of bingo.

The fifth panel 42 further comprises a second portion of hook and loop fastener 44 and an handle 46. The second portion of hook and loop fastener 44 is positioned on the fifth panel's 42 second surface such that when the main member 20 is folded along the panels the second portion of hook and loop fastener 44 selectively engages with the first portion of hook and loop fastener 28 positioned on a first panel's 26 first surface.

The handle member 46 is positioned on the fifth panel's 42 first surface for facilitating carrying of the main member 20.

In use, the main member is opened by disengaging the second portion of hook and loop fastener from the first portion of hook and loop fastener. The main member is unfolded and positioned adjacent to an edge of a table. The clamp member is then secured to the table and engages the main member via the slit. The main member is now positioned such that the accessories are available to the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accessory carrying case adapted for carrying items related to the game of bingo, comprising:

a main member having a first surface and a second surface, said main member being substantially rectangular;

a plurality of pockets, each one of said plurality being positioned on said second surface of said main member, each one of said plurality of pockets being adapted for holding an accessory related to the game of bingo;

a clamp member being used to selectively couple said main member to a table; and wherein said main member includes a first panel member having a width and a length, said length being substantially less than said width, said first panel member having a first panel first surface and a first panel second surface each corresponding to said first and second surfaces of said main member, a second panel member adjacent to said first panel, said second panel having a width and a length, said length being substantially greater than said width, said second panel member having a second panel first surface and a second panel second surface each corresponding to said first and second surfaces of said main member, a third panel member adjacent to said second panel member, said third panel member having a width and a length, said length being substantially less than said width, said third panel member having a third panel first surface and a third panel second surface each corresponding to said first and second surfaces of said main member, a fourth panel member adjacent to said third panel member, said fourth panel member having a width and a length, said length being substantially greater than said width, said fourth panel member having a fourth panel first surface and a fourth panel second surface each corresponding to said first and second surfaces of said main member, and a fifth panel member adjacent to said fourth panel member, said fifth panel member having a width and a length, said length being substantially less than said width, said fifth panel member having a fifth panel first surface and a fifth panel second surface each corresponding to said first and second surfaces of said main member.

2. The accessory carrying case of claim 1, wherein said main member further comprises:

said main member being foldable along respective boundaries between said first, second, third, fourth and fifth panels whereby said second surface of said main member is substantially an interior surface when said main member is folded and said first surface is substantially an exterior surface when said main member is folded.

3. The accessory carrying case of claim 1, wherein said fist panel member further comprises:

a first portion of hook and loop fastener positioned on said first panel first surface;

a slit positioned medially on said first panel, said slit being for selectively receiving said clamp member whereby said main member is selectively coupled to a table.

4. The accessory carrying case of claim 1, wherein said second panel further comprises:

a plurality of pockets positioned on said second panel second surface, each one of said plurality of pockets being adapted for receiving and holding an accessory associated with the game of bingo.

5. The accessory carrying case of claim 1, wherein said fourth panel further comprises:

a second plurality of pockets positioned on said forth panel second surface, each one of said second plurality of pockets being adapted for receiving an holding an accessory associated with the game of bingo.

6. The accessory carrying case of claim 1, wherein said fifth panel further comprises:

a second portion of hook and loop fastener positioned on said fifth panel second surface such that when said main member is folded along said panels said second portion of hook and loop fastener is selectively engageable with a first portion of hook and loop fastener positioned on a first panel first surface;

a handle member positioned on said fifth panel first surface for facilitating carrying of said main member.

7. An accessory carrying case adapted for carrying items related to the game of bingo, comprising:

a main member having a first surface and a second surface, said main member being substantially rectangular;

a clamp member being used to selectively couple said main member to a table;

wherein said main member further comprises:

a first panel member having a width and a length, said length being substantially less than said width, said first panel member having a first panel first surface and a first panel second surface each corresponding to said first and second surfaces of said main member;

a second panel member adjacent said first panel member, said second panel member having a width and a length, said length being substantially greater than said width, said second panel member having a second panel first surface and a second panel second surface each corresponding to said first and second surfaces of said main member;

a third panel member adjacent to said second panel member, said third panel member having a width and a length, said length being substantially less than said width, said third panel member having a third panel first surface and a third panel second surface each corresponding to said first and second surfaces of said main member;

a fourth panel member adjacent to said third panel member, said fourth panel member having a width and a length, said length being substantially greater than said width, said fourth panel member having a fourth panel first surface and a fourth panel second surface each corresponding to said first and second surfaces of said main member;

a fifth panel member adjacent to said fourth panel member, said fifth panel member having a width and a length, said length being substantially less than said width, said fifth panel member having a fifth panel first surface and a fifth panel second surface each corresponding to said first and second surfaces of said main member;

wherein said first panel member further comprises:

a first portion of hook and loop fastener positioned on said first panel first surface;

a slit positioned medially on said first panel, said slit being for selectively receiving said clamp member whereby said main member is selectively coupled to a table;

wherein said second panel further comprises:

a plurality of pockets positioned on said second panel second surface, each one of said plurality of pockets being adapted for receiving and holding an accessory associated with the game of bingo;

wherein said fourth panel further comprises:

a second plurality of pockets positioned on said forth panel second surface, each one of said second plurality of pockets being adapted for receiving an holding an accessory associated with the game of bingo;

wherein said fifth panel further comprises:

a second portion of hook and loop fastener positioned on said fifth panel second surface such that when said main member is folded along said panels said second portion of hook and loop fastener is selectively engageable with said first portion of hook and loop fastener positioned on said first panel first surface; and a handle member positioned on said fifth panel first surface for facilitating carrying of said main member.

* * * * *